United States Patent [19]

Thomas

[11] Patent Number: 4,694,753

[45] Date of Patent: Sep. 22, 1987

[54] CONTINUOUS PRODUCTION OF LOW DENSITY BASE GRAIN WITH A SALT-FREE LIQUOR

[75] Inventor: Karen A. Thomas, Leon, Fla.

[73] Assignee: Olin Corporation, Stamford, Conn.

[21] Appl. No.: 834,182

[22] Filed: Feb. 26, 1986

[51] Int. Cl.[4] ..... C06D 5/06

[52] U.S. Cl. ..... 102/289; 102/290; 264/3.2; 264/3.4; 264/3.6

[58] Field of Search ..... 102/289, 290, 291; 264/3.2, 3.4, 3.6

[56] References Cited

U.S. PATENT DOCUMENTS 3,948,697 4/1976 Flanagan et al. ..... 102/290 X 3,954,063 5/1976 Kaufman et al. ..... 102/290 X

*Primary Examiner*—Peter A. Nelson

*Attorney, Agent, or Firm*—Bruce E. Burdick

[57] ABSTRACT

A process for continuously producing double base propellant powder of a low density (specific gravity 1.15 to 1.275). This process uses a salt-free liquor.

3 Claims, 4 Drawing Figures

CLDBG GRAV. DENS. / SPEC. GRAV.

CONTINUOUS PRODUCTION OF LOW DENSITY BASE GRAIN WITH A SALT-FREE LIQUOR

BACKGROUND AND SUMMARY OF INVENTION

This invention relates to a method of making a double base propellant powder (expected classification: Class 264, Subclass 3).

Production of low density double base propellant grains by a continuous globular powder manufacturing process traditionally uses a salt water suspension of discrete particles of a lacquer of nitrocellulose (NC) in ethyl acetate stabilized by addition of diphenylamine to the lacquer. Other solvents and stabilizers could be used so long as the solvent is immiscible in water. That process is described in detail in U.S. Pat. No. 3,679,782, issued July 25, 1972 to Andrew and Halverson entitled "Manufacture of Globular Powder", commonly assigned herewith, which is incorporated by reference herein as if set forth at length. The '782 patent notes the necessity for a dewatering salt to osmotically force out any water in the lacquer.

Prior to the process of the '782 patent, double base propellant was, for 30 years, only made by a batch process substantially as described in U.S. Pat. No. 2,027,114, issued Jan. 7, 1936, where closer control of raw material concentrations is possible. In the continuous process, however, close control of minute concentrations becomes difficult or expensive due to the large volumes of materials and the slow or rapid buildup of materials that can occur because new materials are continuously being added to the process. The level of dewatering salt is one such concentration. If the dewatering salt concentration is 3.5 to 6 percent by weight of the liquor, then control is not so hard and there is enough leeway to allow for minor production errors. However, if the salt concentration must be maintained at a constant very low level (i.e. less than about two tenths of a percent), then production control becomes difficult, especially if this is attempted in equipment which is designed to control to much less precise concentrations. However, since the dewatering salt was necessary to control final grain density, a solution to the problem of how to control dewatering salt concentrations to the levels (0.1%–0.2% by weight) necessary to produce low density (i.e. with a specific gravity of 1.150 to 1.275) base grains by a continuous production process was not obvious and the production of low density base grain by the continuous process was therefore not thought to be practical or economical. A solution to this problem was needed but, despite year after year of research effort, went unrealized.

The solution only came when Olin Corporation, the assignee, hired a young new engineer who addressed the problem without the knowledge that it couldn't be solved. The solution of the present invention was to eliminate the dewatering salt which had been thought to be necessary and to control grain density in other ways (e.g. by compressively rolling the grains).

The invention will be better understood and clarified by the following description and the drawing in which FIG. 1 is a schematic flow diagram for the process of the invention.

DETAILED DESCRIPTION

Figure 1:
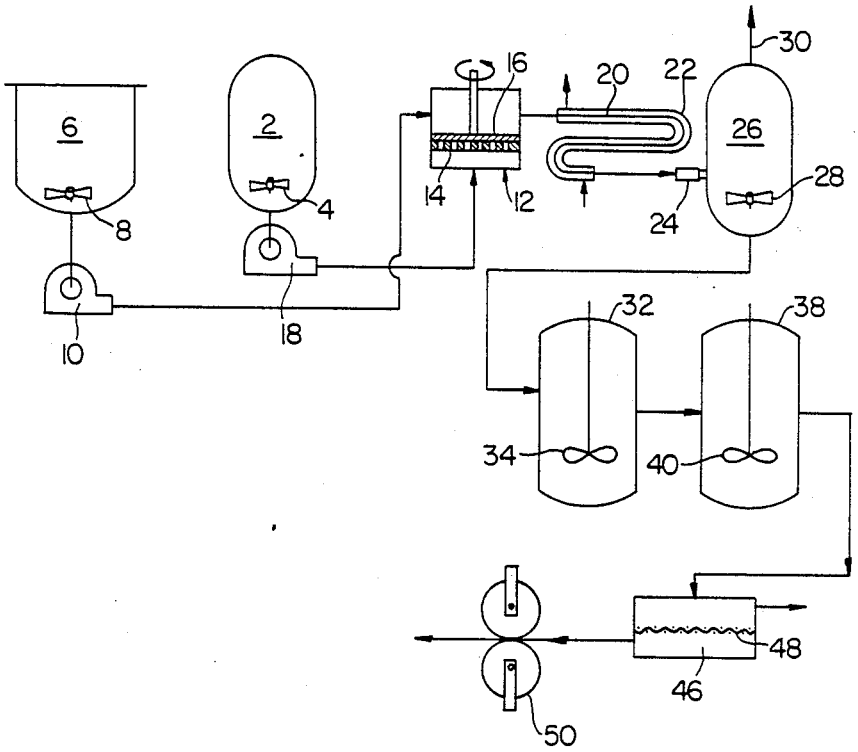

The drawing is the same drawing as that for the process of the '782 patent with one exception, a roller 50 is added since it is the preferred means for grain density control in the salt-free continuous low density base grain process (the CLDBG process). Unless otherwise indicated, all the proportions of the materials used are given in parts by weight of the resulting mixtures.

The lacquer is prepared by mixing together the smokeless powder base and a solvent in a mixing unit 2 equipped with an agitator 4. The smokeless powder base is preferably nitrocellulose which may be in the form of ground and extracted FNH (flashless non-hydroscopic) powder which is wholly or partly purified or any water wet nitrocellulose. The only requirements for the solvent are that it be a solvent for the smokeless powder base and be substantially immiscible with the suspending medium and that it be removable from the nitrocellulose by suitable extraction methods. In the case where nitrocellulose is the smokeless powder base and the suspending medium or liquor is an aqueous solution, such solvent may include ethyl acetate, isopropyl acetate, butyl acetate, ethyl formate, methyl ethyl ketone, methyl isoprophyl ketone, diethyl ketone and mixtures thereof and the like. A stabilizer for nitrocellulose such as diphenylamine may be added to the vat 2 in a small amount of about 0.2 to 0.7 percent.

The viscosity of the lacquer should be controlled to provide uniform extrusion and permit hardening of the grains without distortion. Generally, the viscosity may range from about 5 seconds to 17 seconds as measured by the falling rod method. The falling rod method entails utilizing a 0.314 inch diameter stainless steel rod weight 60 grams and dropping it from the lacquer surface into the lacquer for a distance of 2.31 inches. The time required for the rod to move this distance is the viscosity in seconds. If the viscosity is too low, the shape of the resulting grains is often distorted. If the viscosity is too high, the particles often do not assume a rounded shape and do not have the required density. Although a viscosity of 6 to 17 seconds may be used, 12 to 15 seconds is the preferred range for making grains having a final size of 0.020 to 0.030 inch.

The ingredients is mixing unit 2 are agitated and brought to a temperature between about 60° to about 70° C. The agitation of the mixture should continue until the lacquer becomes homogeneous.

Currently with the preparation of the lacquer, a liquor which forms the suspending medium is prepared by mixing together in a separate tank 6 which is provided with an agitator 8, the proper suspending vehicle and a protective colloid. As has been stated above, the suspending vehicle should be a non-solvent with respect to the smokeless powder base and also immiscible with the lacquer. For reasons of economy, such vehicle is usually water. The protective colloid may be selected from any one of the following materials: cornstarch, gum arabic, animal bone glue, dextrine, bentonite or the like.

Respective percentages of the various ingredients constituting the liquor may be: the suspending vehicle between about 94 and about 97 percent, the protective colloid between about 2. and about 4. percent.

In addition, a solvent, usually the solvent employed in the preparation of the lacquer, may be added to the liquor in an amount of between about 1 and about 3 percent to prevent migration of the solvent from the lacquer globules during the presizing, shaping and dewatering operation. The solvent may be added to the tank 6 or it may be metered into the liquor line.

The ingredients in the tank 6 are mixed together by means of the agitator 8 and heated to about 50° to about 65° C. The liquor is pumped by means of a pump 10 to the downstream side of the presizing plate of presizing unit 12.

The presizing unit 12 comprises a presizing extrusion plate 14 having a plurality of orifices therein and a rotating knife 16 to cut the extrudate into cylindrical particles having a diameter-to-length ratio of approximately 1 to 1. The lacquer is pumped by means of a pump 18 through the extrusion plate 14 and is cut into the appropriate size particles by the knife 16. The liquor is pumped into the presizing unit at a point immediately above the extrusion plate 14. As soon as the lacquer is cut into cylindrical particles, the particles are immediately immersed and suspended in the liquor to form a slurry. The slurry of lacquer particles and liquor is then forced through a dewatering and shaping line 20.

The shaping line 20 may be a long section of tubing provided with suitable means to raise and maintain the temperature of the slurry to between about 75° to 85° C. and preferably between about 76° and 79° C. Such means may be in the form of a water bath in which the section of pipe or tubing is immersed, or by means of a coaxial tube, the inner one of which provides the path for the slurry and the outer one 22 provides a path for steam or other fluid of proper temperature to pass in heat exchange relationship. A nozzle or construction 24 is provided in the outlet end of the line 20 so that the slurry up to this point is maintained between a pressure slightly above atmospheric and a pressure of three atmospheres. As the slurry travels through line 20, the cylindrical particles of lacquer tend to assume a spherical or near-spherical shape due to the molecular and interfacial forces acting on the grain as well as the turbulance within the line.

After the slurry passes through constriction 24 it enters a series of evaporation, beginning with a flash chamber or evaporator 26 which is provided with a suitable agitator 28. The flash chamber 26 is maintained at a temperature approximately equal to the temperature of the incoming slurry or slightly greater if desired. The pressure within the evaporator is less than the pressure within the shaping line 20 so that the exposure of the slurry to the reduced pressure will cause the solvent to rapidly migrate from the grain surface and volatilize. As in all evaporators, the volatilized solvent may be withdrawn through outlet 30 by suitable means and recovered by condensation. The length of time a particular grain stays in the flash chamber depends basically on the level of the slurry contained therein and may be anywhere from 15 to 60 minutes. During the process, about 60 to 80 percent of the solvent in the globule is removed and the grain becomes relatively hard and resistant to further deformation.

After the appropriate interval of time, the slurry is passed to additional evaporators. There should be from about 2 to 5 further evaporators (32 and 38 in FIG. 1) which are individually heated and provided with agitators 34 and 40. The slurry may be transported between evaporators by a gravity flow or by pump. Some or all of the evaporators may have a progressively higher temperature so that the temperature of the slurry is increased as it moves through the evaporators. Most of the remaining solvent is extracted from the grain during this operation and is volatilized and recovered by condensation. The temperature gradiant between adjacent evaporators may be increased in the final stages of evaporation.

The evaporator immediately following the flash may be 2° to 5° C. above the temperature of the flash evaporator. Depending on the sizes and number of evaporators, the following evaporator may have a temperature of 4° to 6° above the second, and the temperature may be raised about 8° or 9° C. in the final evaporator. The important consideration being that the temperature gradient between adjacent evaporators should be smaller in the beginning and then may be increased in the later stages. If the temperature is raised too quickly and too great an amount, the grains may become thermally shocked and distorted. The retention time of the grains within the final hardener is between about 10 and 40 minutes depending upon the process conditions.

As the slurry passes from the final evaporator, it enters a catch box 46 wherein the hardened spherical powder is separated from the liquor by means of a suitable screen 48. The hardened powder is now ready for further processing such as nitroglycerine impregnation, deterrent coating and the like to provide a finished product. The liquor is cooled, reprocessed and cycled back to the graining chamber and the condensed solvent is reused to make lacquer.

Among the steps in further processing is generally a rolling step in which the base grains are passed through a pair of rolls 50 and compressed to a desired final shape. This rolling operation was found to consistently adjust the gravimetric density of the grain to within the 0.675 to 0.800 g/cc range.

EXAMPLES

The major variables of interest in graining were specific gravity, liquor salt concentration, shaper temperatures, and evaporator temperatures. The production specification for specific gravity (1.15–1.275) was used as the criterion for acceptable powder. Four preliminary graining trials were run to establish operating conditions. The first graining trial was conducted with a liquor salt concentration of 0.28% and produced powder with a specific gravity of 1.385. The salt concentration was dropped to 0.18% in the second trial and resulted in a specific gravity of 1.274, at the upper limit of the acceptable range.

Very low salt concentrations would be difficult to accurately maintain in a production situation. The third liquor batch was made without salt, but contained a small amount of salt (0.06%) from residual liquor in the shapers. In this trial, shaper and evaporator temperatures were varied to determine a combination that resulted in powder with acceptable specific gravity. Most of the powder from this trial was in the low end of the acceptable range for specific gravity.

The fourth liquor batch contained no measurable traces of salt. Again, temperatures were varied to determine the best graining conditions. The temperature profile from this trial that resulted in the best specific gravity (1.211) was used for almost all subsequent production of low density base grain. Results of the preliminary graining trials are summarized in Table I below.

In view of this initial success with salt-free liquor, approximately five thousand pounds of experimental 0.028"/0.020" cut low density base grain were produced in the continuous process with the operating conditions summarized in Table II below.

Figure 2:
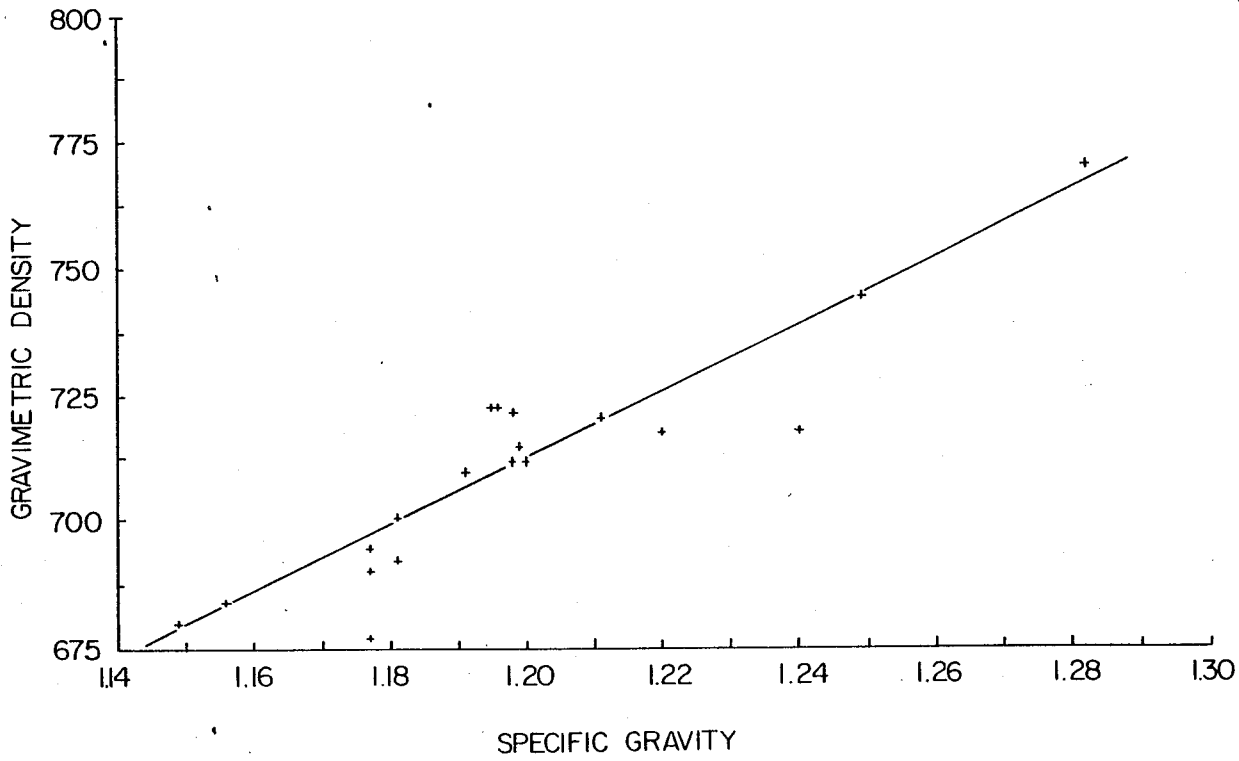
FIG. 2 is a graph of the densities of propellant produced by the process of the invention.

Samples of specific gravity, gravimetric density, and residual solvent were taken every four hours during graining. FIG. 2 shows the relationship between the gravimetric density and specific gravity of the samples.

The specifications for production low density base grain are:

Specific gravity - 1.115 1.275

Gravimetric density - 0.700 0.800 g/cc

As shown in FIG. 2, the continuous powder was nearly always within the desired range for specific gravity, but was often lower than the minimum of 0.700 g/cc in gravimetric density. This lower gravimetric density is probably due to the more uniform spherical shape of the continuously grained material.

Figure 3:
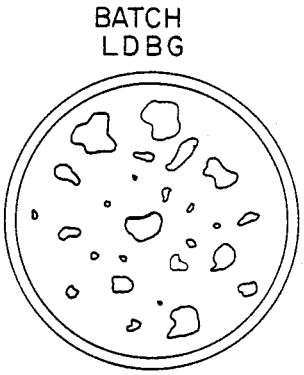
FIG. 3 PRIOR ART
FIG. 3 is a diametrical cross-section of a typical propellant grain of the Prior Art.
Figure 4:
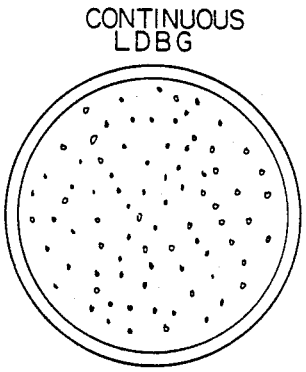
FIG. 4 is a diametrical cross-section of a typical propellant grain of the invention.

Both the powders produced by the batch process using a low (0.1% to 0.2%) salt liquor and powders produced by the continuous process using a salt-free liquor were found to be low in density because of their porous structures. The batch powder has large, irregular pores, as shown in FIG. 3. Continuous powder has pores which are very small and homogeneously dispersed in the grains (FIG. 4). Continuous powder is also more consistent in size (better yield) and in shape (better quality) than batch powder. Any effects of these physical differences on the coating and ballistic performance was unknown.

Several coatings were made with the continuous powder. All were done with 29% nitroglycerine and from 1% to 3% ethyl centralite. The continuous base grain was lower in gravimetric density than the batch base grain for the same specific gravity. After coating and rolling, however, the continuous powder was very similar to batch powder in gravimetric density. Some of the powder was coated with vinsol.

An example ballistic comparison of a batch powder and a continuous powder is shown in Table III. These two powders are similar chemically and ballistically. The only noticeable difference between batch and continuous powder was that the continuous powder consistently required slightly less deterrent for the same ballistic performance. The continuous powder was similar to the batch powder in tests for nitroglycerine temperature sensitivity. Two sample blends (WSX TM 120 and WSX TM 140) of LDBG produced according to the invention by a continuous LDBG process using a salt-free liquor were tested ballistically. Ballistic and chemical information on these powders (X4050 and X4052) is shown in Tables IV and V. Continuous powder was also successfully density-lowered, which would be necessary for clay target shooting.

CONCLUSIONS

Continuous and batch powders are different in physical characteristics, but similar in ballistic performance. Possible advantages in the use of continuous graining include improved shape and higher yield.

It will be appreciated that one of the advantages of the present invention is the fact that by the use of a dewatering and shaping line, an individual particle can be shaped into a substantially spherical body in the order of 3 to 10 minutes. In accordance with previous processes for low density powders, at least three hours was required to form the spherical particles and dewater the grain. In addition, the use of a flash chamber wherein only a portion of the solvent is removed in combination with a plurality of evaporators which are maintained at increasing temperatures reduces the time required to harden the spherical particles from about 5 hours to 1¼ hours. Moreover, the combining of the various steps of the present process permits a truly continuous powder making operation resulting in a higher rate of production of powder for a given amount of equipment.

TABLE I

PRELIMINARY GRAINING TRIALS

| Trial # | Liquor Salt % | Lacquer H2O/NC | Shaper Temps., °C. A | B | C | D | Evap. Temps., °C. A | B | C | Spec. Grav. |
|---|---|---|---|---|---|---|---|---|---|---|
| 1 | 0.28 | 0.396 | 76 | 76 | 77 | 78 | 78 | 84 | 92 | 1.385 |
| 2 | 0.18 | 0.397 | 74 | 74 | 75 | 76 | 80 | 83 | 85 | 1.274 |
| 3 | 0.06 | 0.357 | 76 | 76 | 76 | 77 | 78 | 84 | | 1.159 |
| | | | 76 | 78 | 79 | 79 | 78 | 82 | | 1.177 |
| | | | 77 | 76 | 75 | 74 | 76 | 80 | | 1.143 |
| | | | 77 | 76 | 75 | 74 | 78 | 82 | | 1.152 |
| | | | 77 | 76 | 75 | 74 | 78 | 84 | | 1.163 |
| 4 | 0.0 | 0.342 | 77 | 76 | 79 | 78 | 80 | 84 | 92 | 1.186 |
| | | | 77 | 76 | 79 | 78 | 78 | 84 | 92 | 1.182 |
| | | | 77 | 76 | 79 | 78 | 79 | 84 | 92 | 1.211 |
| | | | 76 | 76 | 79 | 79 | 79 | 84 | 92 | 1.190 |
| | | | 76 | 77 | 79 | 79 | 79 | 84 | 92 | 1.190 |

TABLE II

OPERATING CONDITIONS

| | Range | Average |
|---|---|---|
| Lacquer Composition | | |
| 35% rework, 65% new nitrocellulose (Hercules or Expro) in each batch. | | |
| EA/NC weight ratio | 2.2–2.5 | 2.3 |
| Lacquer viscosity | | |
| Drop rod (sec.) | 5–15 | 9.5 |
| Haake (centipoise @ 0.264 sec-1) | 200,000–720,000 | 480,000 |
| Liquor Composition | | |
| % Salt | 0.0 | 0.0 |
| % EA | 1.1–2.3 | 2.0 |
| % Colloid | 2.8–3.6 | 3.2 |
| % Water | 94–97 | 94.8 |
| Temperatures, °C. | | |
| Lacquer kettle | 50–59 | 55 |
| Shaper Average | 76.25–78.0 | 77.4 |
| Shaper exit | 78–79 | 78.7 |
| A evaporator | 78–79 | 78.9 |
| B evaporator | 82–84 | 84 |
| C evaporator | 91–92 | 92 |
| Final Base Grain | | |
| % Residual Solvent | 3.95–4.77 | 4.37 |
| Specific Gravity | 1.149–1.282 | 1.20 |
| % Yield of 0.028"/0.020" cut | 50–82 | 65.5 |
| Gravimetric density, g/cc | 0.677–0.768 | 0.710 |

TABLE III

BALLISTIC COMPARISON OF LOW DENSITY WSX 120

| Sample | Chg. Wt. | Vel. (fps) | EV | Press. (× 100 psi) | EV |
|---|---|---|---|---|---|
| | 20 P & V | | | | |
| Production (Batch) P#3362 | @ 16.8 | 1214 | 36 | 119 | 14 |

TABLE III-continued

| BALLISTIC COMPARISON OF LOW DENSITY WSX 120 | | | | | | | | |
|---|---|---|---|---|---|---|---|---|
| 64-21 10 Pilot Plant (Continuous) AB21472-7 | | | @ 16.8 | | 1205 | 44 | 116 | 19 |
| Sample | M + V | Web | GD | K2S04 | NG | EC | Cut | Vinsol |
| CHEMICAL DATA | | | | | | | | |
| P#3362 | 0.60 | 0.100 | 772 | 0.18 | 26.9 | 1.47 | 0.028"/0.020" | None |
| AB21472-7 | 0.62 | 0.0103 | 797 | 0.22 | 26.0 | 1.32 | 0.028"/0.020" | None |

TABLE IV

| WSX 120 BLEND X4050 | | | | | | | |
|---|---|---|---|---|---|---|---|
| Sample | Chg. Wt. | Vel. (fps) | EV | (× 100 psi) | EV | V | P |
| BALLISTIC DATA 10 P & V | | | | | | | |
| X4050 | 16.8 | 1224 | 48 | 117 | 12 | +12 | +2 |
| X3930 | 16.8 | 1212 | 21 | 115 | 12 | ±0 | ±0 |
| Sample | Temp., °F. | Vel. (fps) | EV | Press × 100 psi | EV | V | P |
| 16 HOUR STORAGE 10 P & V | | | | | | | |
| X4050 | 70 | 1218 | 36 | 124 | 11 | +5 | +2 |
| @16.8 | 125 | 1243 | 27 | 134 | 11 | +25 | +10 |
| | −40 | 1146 | 84 | 117 | 18 | −72 | −7 |
| X3930 | 70 | 1213 | 48 | 122 | 17 | ±0 | ±0 |
| @16.8 | 125 | 1232 | 27 | 129 | 11 | +19 | +7 |
| | −40 | 1135 | 56 | 123 | 23 | −78 | +1 |
| TWO WEEK STORAGE 10 P & V | | | | | | | |
| X4050 | 70 | 1211 | 25 | 105 | 14 | +8 | +1 |
| @16.8 | 125 | 1220 | 33 | 115 | 10 | +9 | +10 |
| | 115 @ 85% | 1189 | 38 | 93 | 11 | −22 | −12 |
| X3930 | 70 | 1203 | 26 | 104 | 15 | ±0 | ±0 |
| @16.8 | 125 | 1229 | 21 | 116 | 12 | +26 | +12 |
| | 115 @ 85% | 1179 | 49 | 89 | 15 | −24 | −15 |
| 30 DAY STORAGE WSX 120 10 P + V | | | | | | | |
| X4050 | 70 | 1221 | 41 | 106 | 10 | +9 | +3 |
| @16.8 | 125 | 1236 | 59 | 115 | 13 | +15 | +9 |
| | 115 @ 85% | 1214 | 38 | 103 | 17 | −7 | −3 |
| X3930 | 70 | 1212 | 21 | 103 | 12 | ±0 | ±0 |
| @16.8 | 125 | 1232 | 23 | 115 | 8 | +20 | +12 |
| | 115 @ 85% | 1201 | 25 | 99 | 16 | −11 | −4 |
| Sample | NG | EC | | Vinsol | Web | G.D | |
| CHEMICAL | | | | | | | |
| X4050 | 27.99 | 1.39 | | None | 0.0095 | 816 | |

TABLE V

| WSX 140 BLEND X4052 | | | | | | | |
|---|---|---|---|---|---|---|---|
| Sample | Vel. (fps) | EV | Press × 100 psi | EV | V | P | |
| BALLISTIC DATA 10 P & V | | | | | | | |
| X4052 @29.5 | 1369 | 40 | 118 | 17 | +5 | ±0 | |
| X3813 | 1364 | 52 | 118 | 28 | ±0 | ±0 | |
| Sample | Temp. °F. | Vel. (fps) | EV | Press × 100 psi | EV | V | P |
| 16 HOUR STORAGE 10 P & V | | | | | | | |
| X4052 | 70 | 1374 | 20 | 125 | 10 | +23 | 4 |
| @29.5 | 125 | 1400 | 40 | 140 | 19 | +26 | +15 |
| | −40 | 1272 | 32 | 104 | 17 | −102 | −21 |
| X3813 | 70 | 1351 | 69 | 121 | 16 | ±0 | ±0 |
| @29.5 | 125 | 1337 | 38 | 111 | 19 | −14 | −10 |
| | −40 | 1271 | 65 | 110 | 24 | −80 | −11 |
| Sample | N.G. | E.C. | | Vinsol | Web | G.D. | |
| CHEMICAL DATA | | | | | | | |
| X4052 | 25.75 | 1.82 | | 1.3% add | 0.0084 | 643 | |

What is claimed is:

1. In the art of making spherical, single-base low density powder grains from discrete particles of a lacquer of a single smokeless powder base and a solvent therefore, the method comprising the steps of (a) continuously forming a single-base lacquer into substantially spherical particles while entrained in a salt-free liquor suspending medium which is a non-solvent for the powder base and substantially immiscible with said solvent, (b) coating the formed spherical particles with a deterrent; and (c) rolling the particles to produce an oblate spheroidal grain of a specific gravity within the range of from about 1.15 to about 1.275.

2. The method of claim 1 further comprising the step of impregnating spherical particle with nitroglycerine prior to the rolling step.

3. A powder produced by the method of claim 1 which has pores of maximum size of 0.03 mm (0.001 inch) homogeneously dispersed throughout the grains.

* * * * *